US010144057B2

(12) United States Patent
Onishi et al.

(10) Patent No.: US 10,144,057 B2
(45) Date of Patent: Dec. 4, 2018

(54) METHOD FOR MANUFACTURING FORGED STEEL ROLL

(71) Applicant: NIPPON STEEL & SUMITOMO METAL CORPORATION, Tokyo (JP)

(72) Inventors: Hirofumi Onishi, Tokyo (JP); Akihiro Yamanaka, Tokyo (JP); Hideo Mizukami, Tokyo (JP); Tomoaki Sera, Tokyo (JP); Hideyoshi Yamaguchi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 148 days.

(21) Appl. No.: 14/378,763

(22) PCT Filed: Feb. 1, 2013

(86) PCT No.: PCT/JP2013/000567
§ 371 (c)(1),
(2) Date: Aug. 14, 2014

(87) PCT Pub. No.: WO2013/125162
PCT Pub. Date: Aug. 29, 2013

(65) Prior Publication Data

US 2015/0026957 A1 Jan. 29, 2015

(30) Foreign Application Priority Data

Feb. 21, 2012 (JP) ..... 2012-035164

(51) Int. Cl.
*C22C 38/00* (2006.01)
*B22D 7/00* (2006.01)
(Continued)

(52) U.S. Cl.
CPC ..... *B22D 7/00* (2013.01); *B21J 1/025* (2013.01); *B21K 1/02* (2013.01); *B22D 23/10* (2013.01);
(Continued)

(58) Field of Classification Search
CPC ... B21J 5/002; B21J 1/003; B21J 1/02; B21K 1/06; F16C 13/00; F16C 2322/12;
(Continued)

(56) References Cited

U.S. PATENT DOCUMENTS 4,008,752 A * 2/1977 Rabinovich ..... B22D 23/10 164/515
5,522,914 A * 6/1996 Stasko ..... B22F 9/082 419/10
(Continued)

FOREIGN PATENT DOCUMENTS

CN 101153377 4/2008
JP 61-9554 1/1986
(Continued)

*Primary Examiner* — Christopher Besler
(74) *Attorney, Agent, or Firm* — Clark & Brody

(57) ABSTRACT

A method for manufacturing a forged steel roll comprises: casting, by the ESR method, a steel ingot which contains, by mass %, C: 0.3% or more, Si: 0.2% or more, Cr: 2.0-13.0% and Mo: 0.2% or more, and further contains Bi at 10-100 ppm by mass; and forging the steel ingot to manufacture the roll. According to this method, since freckle defects can be sealed near the center of the steel ingot, the roll can be stably used over a long period of time.

1 Claim, 3 Drawing Sheets

(51) Int. Cl.

| | |
|---|---|
| ***B22D 23/10*** | (2006.01) |
| ***C22C 38/22*** | (2006.01) |
| ***C22C 38/46*** | (2006.01) |
| ***C22C 38/02*** | (2006.01) |
| ***C22C 38/04*** | (2006.01) |
| ***C22C 38/44*** | (2006.01) |
| ***C22B 9/18*** | (2006.01) |
| ***C21D 9/38*** | (2006.01) |
| ***B21J 1/02*** | (2006.01) |
| ***B21K 1/02*** | (2006.01) |
| *C21D 7/13* | (2006.01) |

(52) U.S. Cl.
CPC ..... *C21D 9/38* (2013.01); *C22B 9/18* (2013.01); *C22C 38/00* (2013.01); *C22C 38/002* (2013.01); *C22C 38/02* (2013.01); *C22C 38/04* (2013.01); *C22C 38/22* (2013.01); *C22C 38/44* (2013.01); *C22C 38/46* (2013.01); *C21D 7/13* (2013.01); *Y10T 29/49988* (2015.01)

(58) Field of Classification Search
CPC ... B22D 23/10; B22D 23/06; Y10T 29/49544; Y10T 29/49565; Y10T 29/49753; Y10T 29/49988; C22C 35/005; C22C 38/002; C22C 28/02; C22C 28/12; C22C 28/18
See application file for complete search history.

(56) References Cited

U.S. PATENT DOCUMENTS

| | | | | |
|---|---|---|---|---|
| 2005/0161125 | A1* | 7/2005 | Ozaki | C21D 1/10 148/334 |
| 2008/0181807 | A1 | 7/2008 | Saiger | |
| 2011/0002807 | A1* | 1/2011 | Saitoh | C22C 38/02 420/83 |
| 2012/0014828 | A1* | 1/2012 | Miyazaki | B22D 11/00 420/40 |
| 2013/0101457 | A1* | 4/2013 | Aiso | C22C 38/001 420/83 |

FOREIGN PATENT DOCUMENTS

| | | | | |
|---|---|---|---|---|
| JP | 04-111962 | | 4/1992 | |
| JP | 2000-239779 | | 9/2000 | |
| JP | 2003-33864 | | 2/2003 | |
| SK | 280 604 | | 5/2000 | |
| WO | WO 2010/140509 | A1 * | 12/2010 | C22C 38/02 |
| WO | WO 2012/008405 | A1 * | 1/2012 | C22C 38/001 |

* cited by examiner

METHOD FOR MANUFACTURING FORGED STEEL ROLL

TECHNICAL FIELD

The present invention relates to a method for manufacturing a forged steel roll for cold or warm use, and particularly relates to a method for manufacturing a forged steel roll which can maintain satisfactory surface properties even when cutting of the roll surface is repeated in association with its long-term use.

BACKGROUND ART

In general, forged steel rolls are manufactured, due to their large diameter, by casting large-scaled ingots (steel ingots) by the ingot-making method and forging the ingots. In the large-scaled ingots, a macro segregation called as ghost segregation tends to occur from the center to the vicinity of the surface during casting, and this ghost segregation remains inside the manufactured forged steel rolls as a segregation even after passing through a forging step and a heat-treatment step.

FIG. 1 is a longitudinal sectional view of a general ingot obtained by the ingot-making method. As shown in this figure, V segregation and ghost segregation appear inside the ingot as general macro segregations. The V segregation is formed of V shape in the central part of the ingot, and includes dense V segregation in the upper portion and pale V segregation in the lower portion. Settled crystals exist below the pale V segregation. The ghost segregation, in which C, P, Mn or other alloy components are thickened, is located in an area extending from the outside of the V segregation to a position of about ½ of the radius of the ingot, and has a linear segregation line shape extending in the vertical direction of the ingot.

Since the generation position of the ghost segregation is closer to the ingot surface than that of the V segregation, cracks starting from the ghost segregation can be caused, in the forging and heat-treatment steps following the casting of the ingot, by stresses in processing deformation and thermal stresses in heat treatment to cooling.

Further, forged steel rolls, when the surface of the forged steel rolls is worn or abraded during use, are repaired by cutting the roll surface to restore the smoothness into a regulated range. If the ghost segregation is left in the surface vicinity of the forged steel rolls on that occasion, segregation lines can be exposed to the surface of the rolls by this cutting repair, even if no defects such as cracks are caused in the original manufacturing process. When a roll with exposed segregation lines is used for processing such as rolling, the roll itself becomes unsuited for reuse since the segregation lines are transferred onto a workpiece.

Therefore, it is strongly requested to establish a technique for manufacturing a forged steel roll, which can be stably used over a long period of time without cracking in the forging and heat treatment steps and without exposure of segregation lines by repeated cutting repairs of the surface of the forged steel roll.

When ingots obtained by the ingot-making method are used as a material for forged steel rolls as they are, the quality of the resulting forged steel rolls is noticeably deteriorated, particularly, resulting from the ghost segregation. In this regard, steel ingots obtained by the electroslag remelting (hereinafter referred to as "ESR") method are generally known to have a solidified structure with less segregation. Therefore, as the material for forged steel rolls, the steel ingots obtained by the ESR method are generally applied.

FIG. 2 is a longitudinal sectional view of a general steel ingot obtained by the ESR method. Inside the steel ingot, freckle defects appear in the vicinity of an area of about ½ of the radius of the steel ingot where the curvature radius of molten steel pool is increased, depending on the depth of the molten steel pool. The freckle defects appearing inside the steel ingots by the ESR method is minor, compared with the V segregation and ghost segregation appearing inside the ingots by the ingot-making method. Therefore, the application of the steel ingots obtained by the ESR method as the material for forged steel rolls holds promise for improving the quality of forged steel rolls in a fashion.

However, the freckle defect is a channel type segregation having the same generation mechanism as the ghost segregation. Thus, even when the steel ingots obtained by the ESR method are used as the material for forged steel rolls, deterioration in the quality of forged steel rolls resulting from the freckle defects becomes obvious, similarly to that resulting from the ghost segregation.

The generation mechanism of freckle defects can be explained as follows.

In a forging process, light elements such as C, P, and Si in steel are micro-segregated between dendrite trees in the course of solidification. Such micro-segregation molten steel is lower in density than bulk (base metal) molten steel since these light elements are thickened, and receives a vertically upward force opposite to the gravity by buoyancy.

Although the micro-segregation molten steel stops between branch-like dendrite trees in the early stage of generation, it is then slightly moved upward by buoyancy, integrated with another micro-segregation molten steel located further upward, and developed into an aggregate of micro-segregation molten steels, whereby its volume is increased. Such micro-segregation molten steel is further increased in volume through further upward movement and promotion of the integration, and ascended by large buoyancy produced thereby while crossing branches of dendrites existing upward and breaking the branches to further collect other micro-segregation molten steels.

This micro-segregation molten steel freezes in accordance with the progress of solidification during ascending between dendrite trees, and remains a segregation line inside the steel ingot, and this emerges as a freckle defect.

It goes without saying that the freckle defect is more likely to occur as the content of light elements in molten steel is larger, from the point of its generation mechanism.

When the dendrite structure that is a solidified structure is coarse, the volume of the micro-segregation molten steel tends to increase, and the freckle defects tend to be coarsened. This is attributed to that, when the dendrite structure is coarse, an upward flow of molten steel is easily generated due to an increased volume of the micro-segregation molten steel which is generated first between dendrite trees and a small resistance when the micro-segregation molten steel starts ascending by buoyancy.

In general, when the radius of a steel ingot is represented by R, freckle defects tend to occur in the vicinity of R/2 of the steel ingot where the curvature radius of molten steel pool is increased to facilitate apical extension of dendrite arm spacing. However, when the steel ingot is large-sized and high in the content of light elements, the freckle defects tend to be generated also near the surface of the steel ingot, causing a problem such as generation of cracks in the heat treatment step, similarly to the case of the above-mentioned ghost segregation.

As described above, it is strongly requested to establish the technique capable of preventing generation of cracks in the forging and heat treatment steps, in manufacturing of forged steel rolls, and preventing segregation lines from being exposed even when the surface of the forged steel rolls is repeatedly repaired by cutting, so that the forged steel rolls can be stably used over a long period of time. To meet this request, it is necessary to perfectly suppress the freckle defects in the casting stage of steel ingots or sealing the freckle defects at least nearer the center in relation to the surface of the steel ingots.

It is supposed that the generation of freckle defects can be suppressed by miniaturizing the dendrite structure, from a standpoint of its generation mechanism. Although the miniaturization of the dendrite structure can be attained by increasing the cooling rate in casting, even the manufacturing of small-diameter steel ingots at high cooling rate, for example, involves problems such as restrictions on roll diameter of product and an insufficient forge ratio in forging of the steel ingots.

Patent Document 1 describes a method for miniaturizing the dendrite structure by setting the content of P to 0.025 to 0.060 wt %, as a method for improving the surface roughing of a work roll for cold rolling mill since the surface roughing of the roll is caused by the dendrite structure generated during casting. However, since P is generally an impurity element, and causes embrittlement of iron and steel material, it is not preferred to increase the content of P. Further, P is a light element which causes freckle defects as described above, and an increased content of P is considered to encourage the generation of freckle defects.

Patent Document 2 proposes a determination method in a simulator for casting process, which is characterized by simultaneously evaluating a freckle defect evaluation index (Ra number (Rayleigh number)) with consideration for a segregation molten steel flow, or a hetero-crystal defect evaluation index with consideration for a hetero-crystallization mechanism from the concentration or temperature calculated in a casting process simulation based on an optional casting plan to determine the quality of the casting plan. As described in [0057] of this document, although it can be suggested from the calculation example of FIG. 12 in this document that freckle defects are likely to occur at a site where Ra number is 0.07 or larger, defect evaluation reference values must be newly set when the casting material is changed.

CITATION LIST

Patent Document

Patent Document 1: Japanese Patent Application Publication No. 61-009554

Patent Document 2: Japanese Patent Application Publication No. 2003-033864

SUMMARY OF THE INVENTION

Technical Problem

As described above, the miniaturization of dendrite structure in steel ingots as the material for forged steel rolls has problems such as the restrictions on roll diameter and the occurrence of embrittlement or segregation due to increased light element contents. The present invention is achieved in view of such problems, and has an object to provide a method for manufacturing a forged steel roll, capable of perfectly suppressing freckle defects, in casting of a steel ingot as the material for forged steel rolls by the ESR method, or sealing the freckle defects at least nearer the center in relation to a position where freckle defects emerge in conventional steel ingots.

Solution to Problem

As a result of the earnest examinations to attain the above-mentioned object, the present inventors found that the dendrite structure can be miniaturized while suppressing the generation of freckle defects by adding Bi to molten steel, in the process of casting by the ESR method, to cast a steel ingot containing a predetermined amount of Bi. The content of the examinations will be described later.

The present invention is achieved based on this knowledge, and the gist thereof is the following method for manufacturing a forged steel roll. Namely, the method for manufacturing a forged steel roll of the present invention is characterized by casting, by the ESR method, a steel ingot which contains, by mass %, C: 0.3% or more, Si: 0.2% or more, Cr: 2.0-13.0% and Mo: 0.2% or more, and further contains Bi at 10-100 ppm by mass; and forging the steel ingot to manufacture the roll.

In the following description, with respect to the component composition of steels, "%" means "% by mass (mass %)", and "ppm" means "ppm by mass", unless otherwise noted.

Advantageous Effects of the Invention

According to the method for manufacturing a forged steel roll of the present invention, freckle defects that are a macro-segregation generated in casting of a steel ingot by the ESR method can be sealed nearer the center in relation to the surface of the steel ingot. Since cracks starting from the segregation can be thus suppressed during forging and heat treatment of the steel ingot, and segregation lines of the freckle defect are hardly exposed even when the roll is repaired by cutting to reuse the roll, the roll can be stably used over a long period of time.

DESCRIPTION OF EMBODIMENTS

The method for manufacturing a forged steel roll of the present invention is characterized by: casting, by the ESR method, a steel ingot which contains C: 0.3% or more, Si: 0.2% or more, Cr: 2.0-13.0% and Mo: 0.2% or more, and further contains Bi at 10-100 ppm; and forging the steel ingot to manufacture the roll.

The reasons to specify the method for manufacturing a forged steel roll of the present invention as described above and preferred embodiments thereof will be then described.

1. Casting of Steel Ingot by ESR Method

Figure 1:
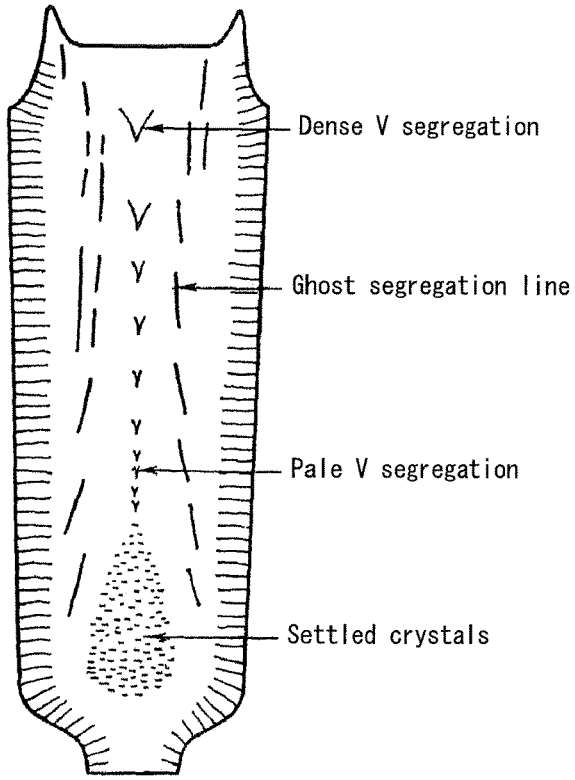
FIG. 1 is a longitudinal sectional view of a general ingot obtained by the ingot-making method.
Figure 2:
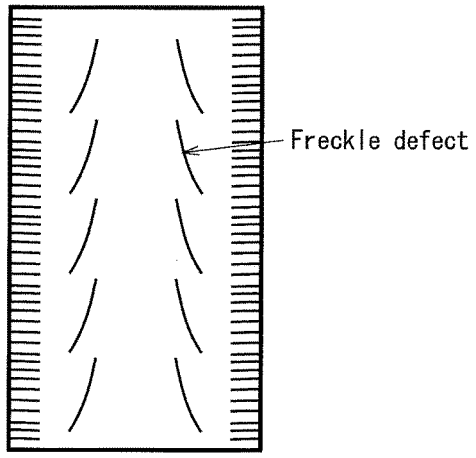
FIG. 2 is a longitudinal sectional view of a general steel ingot obtained by the ESR method.
Figure 3:
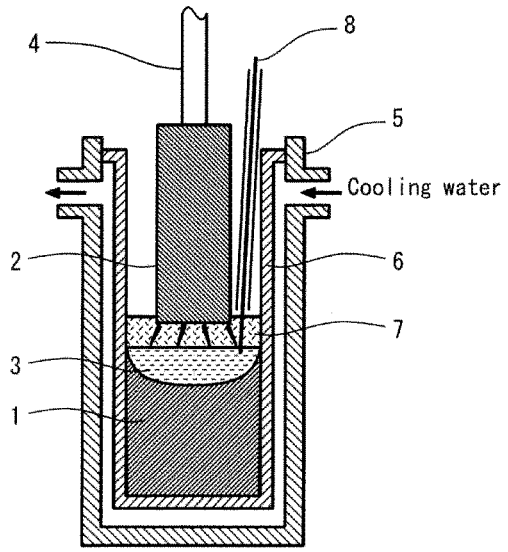
FIG. 3 is a schematic view showing, in the method for manufacturing a forged steel roll of the present invention, one example of casting of a steel ingot used as the material by the ESR method.

FIG. 3 is a schematic view showing, in the method for manufacturing a forged steel roll of the present invention, one example of a state for casting a steel ingot used as the material by the ESR method.

As shown in this figure, in the ESR method, a stub 4 is connected by welding to the upper end of a cylindrical consumable electrode 2 that is a base metal of a steel ingot 1, and the electrode is moved down in accordance with the lowering of the stub 4 by a raising and lowering mechanism not shown. A molten slag 7 is held in a casting mold (water-cooled copper mold) 6 within a chamber 5, and energization is performed with the consumable electrode 2 being immersed in the molten slug 7, whereby electricity is carried to the molten slug 7, and the molten slug 7 generates heat. The consumable electrode 2 is successively molten from the lower end by the Joule heat of the molten slug 7. The molten consumable electrode 2 settles out through the molten slug 7 as droplets, and solidifies in layers while being retained as a pool of molten steel 3 within the casting mold 6. The consumable electrode 2 is successively molten up to the upper end, and the molten steel 3 is successively solidified in the casting mold 6, whereby the steel ingot 1 for the forged steel roll is obtained.

In the present invention, since the steel ingot 1 obtained by the ESR method contains a predetermined amount of Bi, the molten steel 3 must be caused to contain Bi in the process of casting by the ESR method. As a method therefor, Bi may be added to the molten steel 3 in a casting stage by the ESR method, or Bi may be added, at a stage prior to the casting by the ESR method or in the stage of producing the consumable electrode 2 that is the base metal by the ingot-making method, to the molten steel of the electrode.

When Bi is added to the molten steel 3 in the casting stage by the ESR method as the former, the addition of Bi can be attained by supplying a Bi wire 8 containing Bi to the molten steel 3 as shown in FIG. 3. Besides, it can be attained also by preliminary welding the Bi wire to the side surface of the consumable electrode 2 along the axial direction.

In the casting by the ESR method, the temperature of molten steel exceeds 1,600° C. On the other hand, the pure boiling point of Bi is only 1,564° C. which falls below the molten steel temperature. Therefore, when the Bi wire is composed of Bi single body, Bi cannot be effectively retained in the molten steel since Bi is evaporated during casting. Thus, the Bi wire is appropriately composed of an alloy of Bi with Ni or the like. The inclusion of Ni or the like leads to an apparent rise of the boiling point of Bi. When Ni—Bi series is selected as the alloy, the content of Bi in the Bi wire is preferably set to 20 to 70 mass % so that Bi is present in a liquid phase state in the molten steel.

When Bi is added to the molten steel in the stage of producing the consumable electrode 2 as the latter, Bi can be added in prospect of the evaporation amount of Bi during the casting by the ESR method.

2. Component Composition of Forged Steel Roll and Determination Reason Thereof

C: 0.3% or more

C enhances the hardenability of steel. C also enhances the wear resistance of steel by bonding to Cr or V to form a carbide. Therefore, the content of C is set to 0.3% or more, more preferably to 0.5% or more, further preferably to 0.85% or more. The upper limit of the C content is not particularly limited, but when C is excessively contained, sufficient hardness particularly as forged steel rolls for cold rolling cannot be secured, and the toughness and machinability of steel are deteriorated due to uneven distribution of the carbide. Thus, the content of C is preferably set to 1.3% or less, more preferably to 1.05% or less.

Si: 0.2% or more

Si is an element effective for deoxidizing steel. Si also enhances the resistance to temper softening of steel and enhances the hardness of steel by being solid-dissolved in the steel. Therefore, the content of Si is set to 0.2% or more, more preferably to 0.3% or more. Although the upper limit of Si content is not particularly limited, the cleanliness of steel is deteriorated when Si is excessively contained. Thus, the Si content is preferably set to 1.1% or less, more preferably to 0.85% or less, further preferably to 0.6% or less.

Cr: 2.0-13.0%

Cr enhances the hardenability of steel. Cr also enhances the wear resistance of steel by forming a carbide. On the other hand, when Cr is excessively contained, the ductility or toughness of steel is deteriorated due to uneven distribution of the carbide. Thus, the content of Cr is set to 2.0 to 13.0%, more preferably to 2.5 to 10.0%.

Mo: 0.2% or more

Mo enhances the hardenability of steel. Mo also enhances the resistance to temper softening. Therefore, the content of Mo is set to 0.2% or more, more preferably to 0.3% or more. The upper limit of the Mo content is not particularly limited. However, when Mo is excessively contained, the ductility or toughness of steel is deteriorated due to formation of a carbide. Thus, the Mo content is set preferably to 1.0% or less, more preferably 0.7% or less.

Bi: 10-100 ppm

Since C and Si are light elements, freckle defects tend to occur when 0.2% or more Si is contained in high-carbon carbon steel having a C content of 0.3% or more. However, Bi is contained in molten steel in the process of casting by the ESR method to set the content of Bi to 10 ppm or more, as will be described below, whereby the generation of freckle defects can be suppressed. When the content of Bi exceeds 100 ppm, the embrittlement becomes problematic, even if it is a trace amount, in forming a roll by forging. Therefore, the Bi content is set to 100 ppm or less.

The forged steel roll can further contain the following elements, in addition to the above-mentioned essential elements.

Mn: 0.4-1.5%

Mn enhances the hardenability of steel. Further, Mn is an element effective for deoxidizing steel. When Mn is excessively contained, the crack resistance of steel is deteriorated. Therefore, when Mn is aggressively contained, the content thereof is set to 0.4 to 1.5%.

Ni: 2.5% or less

Ni enhances the toughness of steel. Ni also enhances the hardenability of steel. On the other hand, when Ni is excessively contained, hydrogen cracking tends to occur after heat treatment. Since Ni is an austenite forming element, the hardness of steel is deteriorated when Ni is excessively contained. Therefore, when Ni is aggressively contained, the content of Ni is set to 2.5% or less, more preferably to 0.8% or less.

V: 1.0% or less

V enhances the wear resistance of steel by forming a carbide. However, when V is excessively contained, the ductility or toughness of steel is deteriorated due to formation of the carbide. Therefore, when V is aggressively contained, the content thereof is set to 1.0% or less, preferably to 0.2% or less.

In steel ingots having the above-mentioned composition, the dendrite structure becomes fine by casting by the ESR method. Therefore, in forged steel rolls manufactured by forging these steel ingots as the material, freckle detects are perfectly suppressed, or the freckle defects are sealed near the center of the steel ingots, compared with a case in which no Bi is contained, so that no segregation lines are exposed even when the surface of the forged steel rolls is repeatedly repaired by cutting, and the forged steel rolls can be thus stably used also as recycled rolls.

3. Effects of Inclusion of Bi

The present inventors found, by the following unidirectional solidification test, that the dendrite structure can be miniaturized to suppress the generation of freckle defects by causing molten steel to contain Bi in the process of casting by the ESR method so that a resulting steel ingot contains a trace amount (10 ppm or more) of Bi.

3-1. Test Condition

A test was performed for casting of a columnar steel ingot having a diameter of 15 mm and a height of 50 mm by the ESR method. In that regard, steel ingots having Bi contents of 10 ppm, 21 ppm and 38 ppm were produced respectively by adding Bi to molten steels, and a steel ingot free from Bi was also produced without addition of Bi. The cooling rate was set to 5 to 15° C./min in accordance with the condition of real operation.

With respect to each of the obtained steel ingots, spacings each between about 10 primary arms extending substantially in parallel to the axial direction in a longitudinal section passing through the center were measured, and an arithmetic average value thereof was taken as the dendrite primary arm spacing of each steel ingot.

3-2. Test Result

Figure 4:
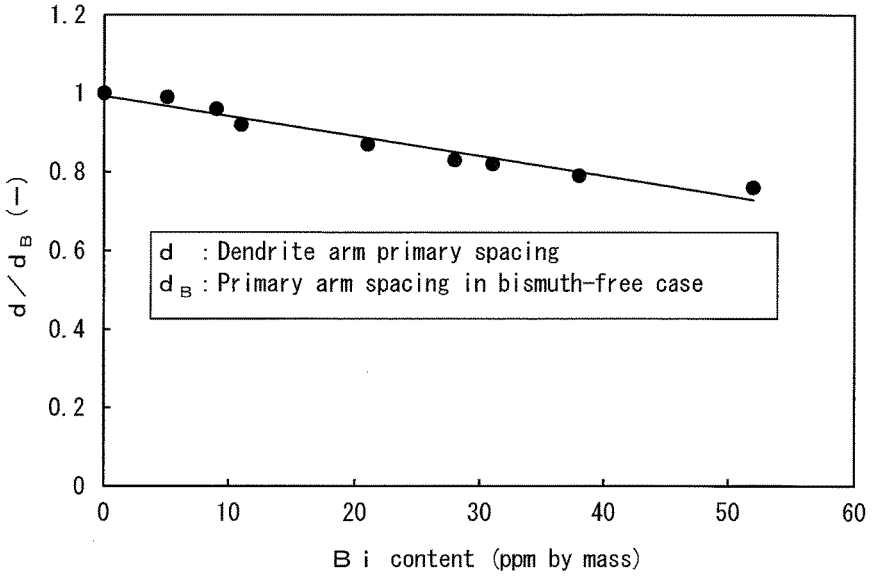
FIG. 4 is a view showing the relationship between Bi content and dendrite primary arm spacing.

FIG. 4 is a view showing the relationship between Bi content and dendrite primary arm spacing. In this figure, dendrite primary arm spacing (d) was shown in the vertical axis as the ratio ($d/d_B$) to dendrite primary arm spacing ($d_B$) of Bi-free steel ingot. It is found from this figure that as the Bi content is higher, the dendrite primary arm spacing of carbon steel is narrower, and the dendrite structure is finer. This is attributed to that Bi is an element having an effect to reduce the interface energy of solid-liquid interface of the carbon steel, and shows an effect on the miniaturization of dendrite primary arm spacing even if its content is trace. If the Bi content is 10 ppm or more, the generation of freckle defects can be effectively suppressed, as shown in examples to be described later.

4. Index of Freckle Defect Generation

The present inventors focused attention on the use of Ra number as a index of freckle defect generation. The Ra number is a dimensionless number indicating a convective flow in temperature field, or a product of Pr number (Prandtl number) and Gr number (Grashof number), and is represented by the following equation (1).

$$Ra = Pr \cdot Gr = g\beta(Ts - T_\infty)L^3/\nu\alpha \quad (1)$$

In the equation, g [$m/s^2$]: gravity acceleration, β [1/K]: volume expansion coefficient, Ts [K]: object surface temperature, $T_\infty$ [K]: temperature of fluid, ν [$m^2/s$]: kinetic viscosity coefficient, α [$m^2/s$]: thermal diffusivity, and L [m]: typical length.

The Ra number is considered physically to be a ratio of buoyancy that is flow-driving force to flow-resisting force, and is proportional to the cube of typical length as shown in the above-mentioned equation (1). If the criticality of freckle defect generation is contemplated, the typical length in the Ra number should be set to the magnitude of micro-segregation between dendrite trees. Since micro-segregation molten steel is filled between dendrite trees in the early state of generation, the magnitude of micro-segregation can be regarded as the dendrite primary arm spacing. Accordingly, the typical length in the Ra number can be set to the dendrite primary arm spacing. Thus, the Ra number can be said to be proportional to the cube of the dendrite primary arm spacing.

As described above, since freckle defects are more likely to be coarsened as the dendrite structure is coarser, the freckle defects are considered to more easily occur as the Ra number is larger. If generation results of freckle defects in actual steel ingots are compared with the Ra number, the Ra number can be taken as an index for the criticality of freckle defect generation. Since the Ra number is proportional to the cube of the dendrite primary arm spacing even if the reduction of the dendrite primary arm spacing by containing a trace amount of Bi in steel ingots is relatively small, the inclusion of Bi in the steel ingots is effective for the reduction in Ra number, and thus extremely effective for suppressing the generation of freckle defects.

EXAMPLES

The effects of the present invention were evaluated by a preliminary test performed actually using steel ingots and a simulation by numerical calculation.

1. Preliminary Test

A casting test of a steel ingot 800 mm in diameter by the ESR method was performed as the preliminary test. As the object steel, a high-carbon steel of 0.87% C-0.30% Si-0.41% Mn-0.10% Ni-4.95% Cr-0.41% Mo-0.01% V (Bi-free) was adopted. The liquidus-line temperature of this steel is 1460° C., and the solidus-line temperature thereof is 1280° C. As the casting conditions, a molten steel scale of 9 t(ton) and a steel ingot length of 2.3 m were adopted.

As a result, no freckle defects were generated up to a position 133 mm radially inward from the steel ingot surface, and freckle defects were generated on the inner side thereof. Namely, the critical point of freckle defect generation was the position 133 mm radially inward from the steel ingot surface. The dendrite primary arm spacing and Ra number at this freckle defect generation critical point were represented by $d_0$ and $Ra_0$, respectively, and used as reference values of the following simulation by numerical calculation.

2. Simulation by Numerical Calculation

Evaluation conditions of the numerical calculation simulation were set as follows. The object steel has the same composition as the above-mentioned preliminary test of 0.87% C-0.30% Si-0.41% Mn-0.10% Ni-4.95% Cr-0.41% Mo-0.01% V, with the content of Bi being 0 ppm (Bi-free), 10 ppm, 21 ppm, and 38 ppm. The diameter of the object steel ingot was set to 800 mm similarly to the preliminary test.

In the above-mentioned evaluation conditions, the solidification rate and cooling rate of each part of the steel ingot were calculated by radial unidimensional non-steady heat transfer analysis of the steel ingot, and distribution of dendrite primary arm spacings in the radial direction from the surface of the steel ingot was calculated by the following equation (2) ("Solidification of Iron and Steel", The Iron and Steel Institute of Japan-Iron and Steel Basic Joint Research, Division of Solidification, 1997, Appendix-4). The equation (2) is an experimental expression of dendrite primary arm spacing d (μm) using solidification rate V (cm/min) and temperature gradient G (° C./cm) as parameters in a case that a Cr—Mo steel is adopted.

$$d=1620V^{-0.2}G^{-0.4} \quad (2)$$

Figure 5:
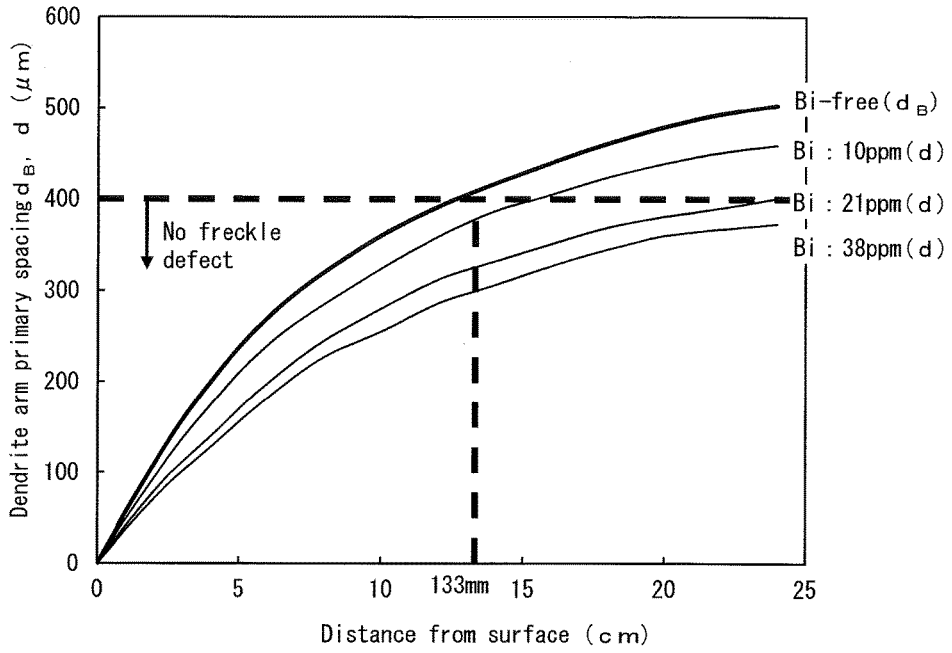
FIG. 5 is a view showing the relationship between the radial distance from steel ingot surface and the dendrite primary arm spacing.

FIG. 5 is a view showing the relationship between the radial distance from the steel ingot surface and the dendrite primary arm spacing. Dendrite primary arm spacing ($d_B$) in the Bi-free case, shown in this figure, was calculated from the above-mentioned equation (2). Dendrite primary arm spacing (d) in the Bi-containing case was calculated by multiplying the ratio ($d/d_B$) of dendrite primary arm spacing with respect to each Bi content (10 ppm, 21 ppm and 38 ppm) shown in the above-mentioned FIG. 4 by the value of $d_B$ which was calculated from the equation (2).

Figure 6:
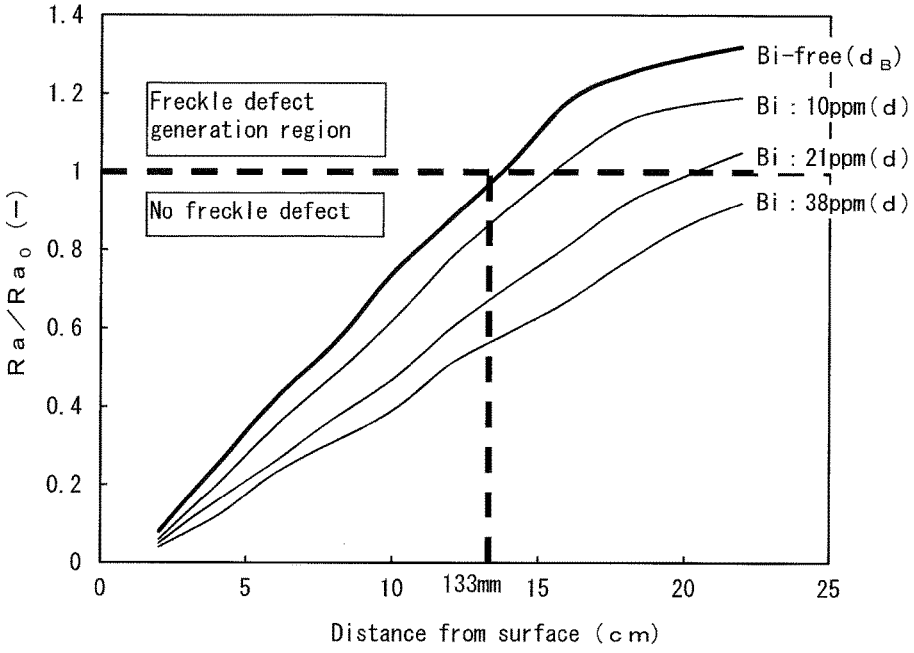
FIG. 6 is a view showing the relationship between the radial distance from steel ingot surface and the value of $Ra/Ra_0$.

FIG. 6 is a view showing the relationship between the radial distance from the steel ingot surface and the value of $Ra/Ra_0$. With respect to the Ra number (Ra) in each Bi content, $Ra/Ra_0$ can be said to be the cube of $d/d_0$, as shown in the following equation (3) derived from the above-mentioned equation (1). The $Ra/Ra_0$ shown in this figure was calculated based on the equation (3).

$$Ra/Ra_0=(d/d_0)^3 \quad (3)$$

In the equation, $Ra/Ra_0$ is the ratio of Ra number (Ra) in each Bi content to basic Ra number ($Ra_0$ determined in the above-mentioned preliminary test), and $d/d_0$ is the ratio of dendrite primary arm spacing d of each Bi-containing steel ingot to dendrite primary arm spacing $d_0$ at freckle defect generation critical point of the Bi-free steel ingot.

It is found from the above-mentioned FIG. 5 that the dendrite primary arm spacing $d_0$ at freckle defect generation critical point of the Bi-free steel ingot is about 400 μm. In the inside of the steel ingot in which the dendrite primary arm spacing d is larger than $d_0$, freckle defects are generated. On the other hand, when Bi is contained in trace amounts (10 ppm, 21 ppm, and 38 ppm), the dendrite primary arm spacing d becomes smaller than the above-mentioned arm spacing at critical point $d_0$ almost over the whole area extending radially from the steel ingot surface. In this case, or when $d/d_0<1$ is satisfied, the generation of freckle defects is suppressed. Since $d/d_0<1$ corresponds to $Ra/Ra_0<1$ from the above-mentioned equation (3), when rephrased using the Ra number, it can be said that the generation of freckle defects is suppressed in the case satisfying $Ra/Ra_0<1$.

According to the above-mentioned FIG. 6, since $Ra/Ra_0<1$ is satisfied up to a rather deep portion (the vicinity of the center of the steel ingot) from the surface of the steel ingot in the Bi-containing case, it was indicated that freckle defects can be sealed not only in the vicinity of the surface of the steel ingot but also near the center, or the generation of freckle defects can be perfectly suppressed.

From the above results, if the content of Bi is 10 ppm or more, the generation of freckle defects can be surely suppressed.

Further, it is supposed from the above-mentioned FIG. 6 that the area where $Ra/Ra_0$ is smaller than 1 in the Bi-containing case is extended closer to the center side of the steel ingot than in the Bi-free case. Therefore, it is quite possible that the purpose to keep the generation position of freckle defects away from the steel ingot surface as much as possible can be attained in optional sizes of steel ingots. However, since actual cooling of steel ingots is not necessarily performed evenly, but is frequently unevenly performed, it is assumable that the dendrite primary arm spacing is partially extended. From this, it is important to set the Bi content to 10 ppm or more.

In addition, when the same preliminary test and simulation were performed by selecting, as the object steel, a high-carbon steel of 1.30% C-0.24% Si-0.32% Mn-0.51% Ni-9.75% Cr-0.50% Mo-0.11% V, the same results were obtained.

As seen from the above, the possible effect by inclusion of a trace amount (10 ppm or more) of Bi in steel ingots was proved.

As mentioned above, since the embrittlement becomes problematic in formation of rolls by forging if the content of Bi exceeds 100 ppm, the Bi content is up to 100 ppm.

Although the shape of the steel ingot was a cylindrical shape in the above-mentioned examples, it is obvious that the same effects can be obtained even when it is a square columnar shape.

INDUSTRIAL APPLICABILITY

According to the method for manufacturing a forged steel roll of the present invention, freckle defects that are a macro segregation generated during casting of steel ingots can be sealed nearer the center in relation to than the surface of the steel ingot. Therefore, cracks starting from the segregation in heat treatment of the steel ingots can be suppressed, and the rolls can be stably used over a long period of time since segregation lines of freckle defects are hardly exposed even when the roll surface is repaired by cutting for reuse.

REFERENCE SIGNS LIST

1. Steel ingot
2. Consumable electrode
3. Molten steel
4. Stub
5. Chamber
6. Casting mold
7. Molten slag
8. Bi wire

What is claimed is:

1. A method for manufacturing a forged steel roll, comprising:

casting, by an electroslag remelting method, a steel ingot which contains, by mass %, C: 0.3% or more, Si: 0.2% or more, Cr: 2.0-13.0% and Mo: 0.2% or more, and further contains Bi at 10-38 ppm by mass; and forging the steel ingot into a roll.

* * * * *